United States Patent [19]

Troiano

[11] 4,413,363

[45] Nov. 8, 1983

[54] PORTABLE SHOWER SYSTEM

[76] Inventor: Joseph Troiano, 80 Mahan St., West Babylon, N.Y. 11704

[21] Appl. No.: 356,185

[22] Filed: Mar. 8, 1982

[51] Int. Cl.[3] ..... A47K 3/22; A47K 3/23

[52] U.S. Cl. ..... 4/599; 4/603; 4/596; 4/615

[58] Field of Search ..... 4/603, 599, 596, 597, 4/602, 615

[56] References Cited

U.S. PATENT DOCUMENTS

| | | | |
|---|---|---|---|
| 1,663,735 | 3/1928 | Talbot et al. | 4/603 X |
| 1,844,038 | 2/1932 | Hooker | 4/599 |
| 2,852,784 | 9/1958 | Winkler | 4/599 |
| 3,293,664 | 12/1966 | Coons | 4/603 |
| 3,332,091 | 7/1967 | Greer | 4/603 |
| 3,381,316 | 5/1968 | Anderson | 4/599 X |
| 3,431,565 | 3/1969 | Nelson | 4/599 X |
| 3,590,398 | 7/1971 | Jetter | 4/599 |
| 3,606,618 | 9/1971 | Veech | 4/603 |
| 3,629,875 | 12/1971 | Dow | 4/599 |

*Primary Examiner*—Henry K. Artis
*Attorney, Agent, or Firm*—Richard L. Miller

[57] ABSTRACT

A portable shower system which when disassembled utilizes its own shower curtain, and base for securing other parts of the system into a compartment in its base so that the entire system can be stored as a single unit, without accidental separation and loss of its various parts.

3 Claims, 3 Drawing Figures

PORTABLE SHOWER SYSTEM

BACKGROUND OF THE INVENTION

This invention relates generally to portable shower stall systems that can be assembled to a position for use and disassembled and packed for transportation.

Portable shower stalls have both industrial and recreational applications. Whenever construction projects or maintenance operations occur where detrimental chemicals or other materials are used on the site, it is often necessary that workers have the opportunity to completely shower down, either as a routine precaution or as an emergency procedure. Because shower facilities are seldom present, portable shower systems are often used.

In addition, vacationers who are in an isolated location often are near water pipes but are without hygienic methods of showering. For these people, campers and workers, portable shower systems are often carried and temporarily erected to provide a welcome means for freshening up.

SUMMARY OF THE INVENTION

A principal object of the present invention is to provide a portable shower system for either workers who require safety showers or people in isolated locations.

It is a further objec of the present invention to provide a portable shower system having a drainage system that is capable of ejecting accumulated water from the shower stall to a selected location.

It is a further object of the present invention to provide a portable shower system that includes a pump for pressuring used water from the shower stall base through an egress and to a selected location.

It is a further object of the present invention to provide a portable shower system that is easily dismounted and stored in the shower stall base for transport.

It is a further object of the present invention to provide a portable shower stall that can be conveniently stored, easily transported.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENT

Figure 1:
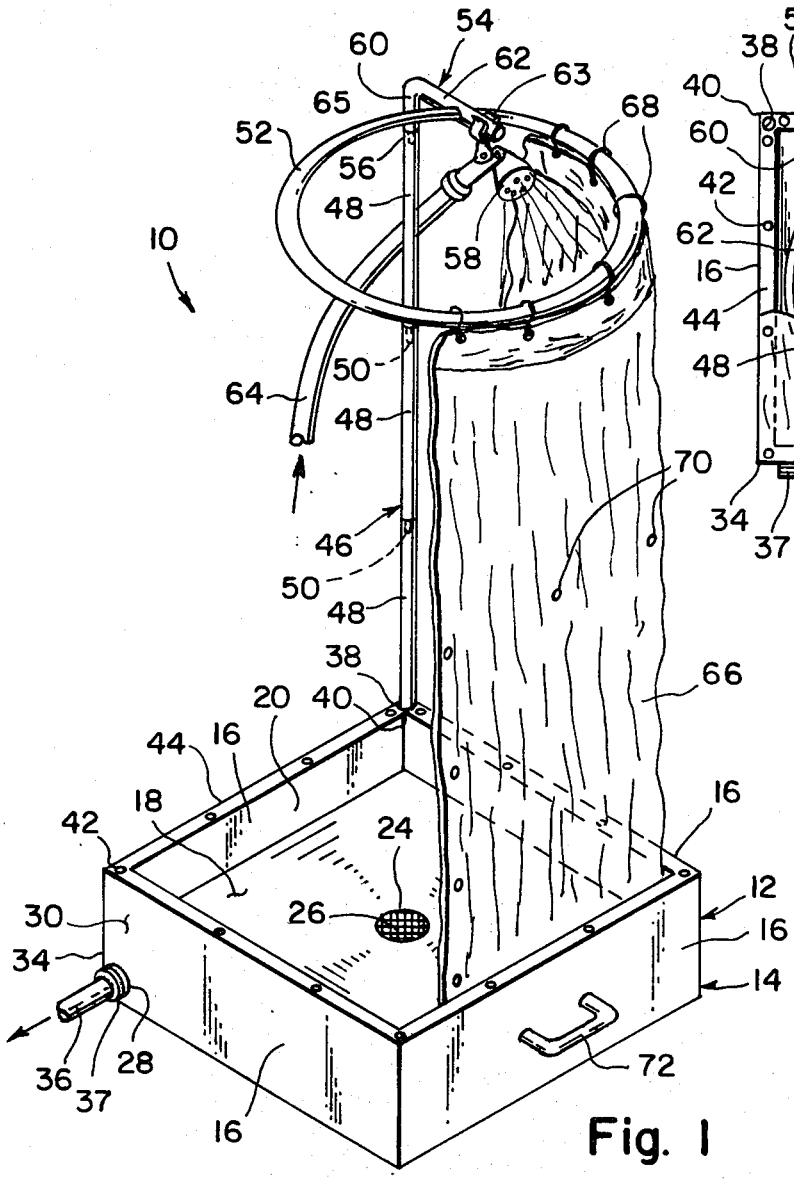
FIG. 1 is a perspective view of the invention as assembled and in use with only a part of the shower curtain shown.

Reference is now made in detail to the drawings. A portable shower system 10 is shown in perspective view in FIG. 1. A base member 12 having a bottom portion

Figure 2:
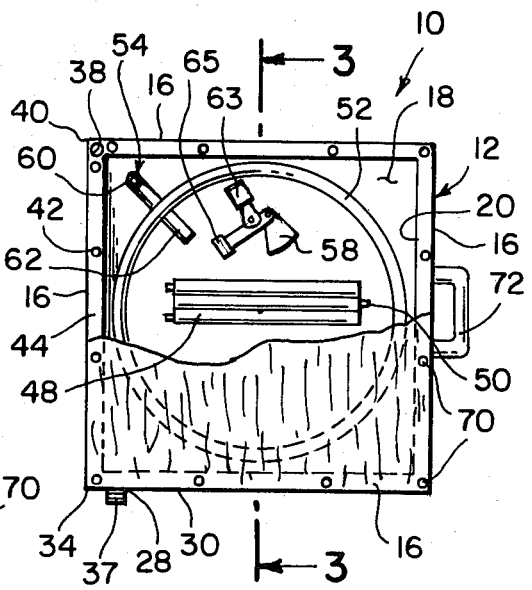
FIG. 2 is a top view of the invention collapsed with part of the cover broken away for purposes of illustration.
Figure 3:
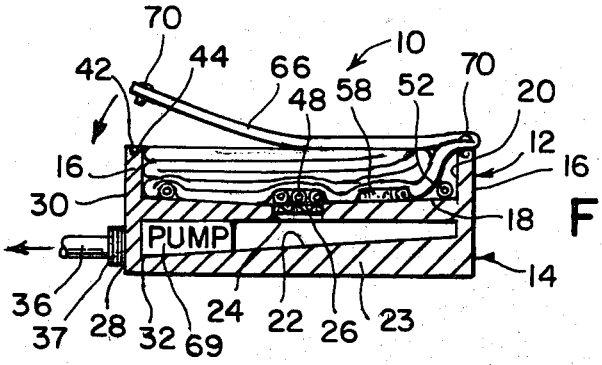
FIG. 3 is a cross-sectional side view taken on line 3—3 of FIG. 2.

14 and four adjoining upright side walls 16 extending upwards a short distance from bottom portion 14. Upright side walls 16 and upper surface 18 of bottom portion 14 form a compartment 20. The configuration of compartment 20 as shown in the preferred embodiment is approximately square when viewed in top view, as shown in FIG. 2, that is, walls 16 are approximately equal. Bottom portion 14, seen in side cross-section in FIG. 3, forms an inner cavity 22. The bottom wall 23 of cavity 22 inclines slightly to one side toward one of the walls 16. A drain, or inlet aperture, 24 connects upper surface 18 of bottom portion 14, that is, compartment 20, with inner cavity 22. The drain is preferably equipped with a drain catch 26. An outlet port, or aperture 28 connects inner cavity 22 with the outer surface 30 of the side wall 16 at the bottom 32 of inclined bottom wall 23. Bottom wall 23 is preferably inclined towards corner 34 of compartment 20. A drain pipe 36 is connected to outlet port 28 via connector 37 and leads to a preselected drainage area (not shown).

Side walls 16 contain an upright bore 38, preferably at a corner 40 different from drainage corner 34. Side walls 16 have connected to them a plurality of one component of connecting snaps 42 approximately equally spaced around wall tops 44. The other components of snaps 42 will be discussed below.

An upright support rod 46 is removably mounted in bore 38. Rod 46 includes a series of rod sections 48, which are removably connected at slide-in connectors 50 to form rod 46.

A mounting ring 52 is connected to a mounting portion 54, which in turn is removably connected to top 56 of support rod 46. Shower head 58 is also removably connected to mounting portion 54. As illustrated in the preferred embodiment, mounting portion 54 includes a section turned at right angles to vertical portion 60. Ring 52 preferably passes through horizontal part on 62 of section 60 by which it is gripped. Shower head 58 preferably is removably connected via biased clamp 63 to the end of horizontal portion 62. Ring 52, which is preferably a lightweight circular rod having a toroidal, or circular, configuration, is positioned horizontally over compartment 20. Shower head 58 is likewise positioned over compartment 20 at a height convenient for a user to stand under. One end of shower head 58 is removably connected to hose 64 via connector 65. Hose 64 in turn is connected to a source of pressurized water. A waterproof, flexible curtain 66 is slidably and removably attached to ring 52 via shower ring connectors 68. Curtain 66 extends downwards into compartment 20. Curtain 66 is equipped with a plurality of mating connecting snaps 70 which fit connecting snaps 42 around the top of walls 16.

A pump 69 is mounted within bottom portion 14 at drainage corner 34 between cavity 22 and drain outlet aperture 28. Pump 69 is to be used when chain pipe 36 cannot be inclined at the proper elevation to drain off used water and the used water must be pressured to the waste water dumping site.

In operation, pressurized water passes from shower head 58 into compartment 20 and through drain 24 into cavity 22, from where it is pumped via pump 69 or runs off by gravitational force through drain pipe 36 to a drainage area. Pump 69 can be of manual type operated by the user, or electrically operated and controlled by a float switch not shown in base cavity 22 as is well known in the art.

Portable shower system 10 can be dismounted as follows. Shower curtain 66 is removed from mounting rung 52. Drain pipe 36 and hose 64 are disconnected via connector 37 and 65 respectively. Shower head 58 is disconnected from mounting portion 54 and mounting portion 54 along with shower curtain mounting ring 52 is disconnected from the top of support rod 46. Support rod 46 is then removed from bore 38 and is subsequently disconnected into rod sections 48. Mounting portion 54 is placed in compartment 20 with rung 52 placed horizontally against upper surface 18. It is noted here that because of the desirability of having ring 52 fit snugly in compartment 20 and in particular having walls 16 in proximity to ring 52 in the dismounted position, the outer diameter of ring 52 is preferably only slightly less than the cross-dimensions of wall 16. Rod sections 48 are likewise placed in the compartment along with shower head 58. Shower hose 64 and drain pipe 36 may also be placed in this compartment or carried separately. Shower curtain 66 is placed inside compartment 20 in such a manner that shower connecting snaps are positioned to snap into mating connecting, connecting snaps 42 of walls 16 so that curtain 66 completely covers the top of compartment 20. When the system is packed it can then be lifted by handle 72 connected to a wall 16. The ring, shower head, and rod sections can of course be optionally clipped into surface 18 of compartment 20 by any of several known methods (not shown).

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A portable shower system, in combination, comprising:

a base member having an inclined base wall four upright side walls, and a flat bottom partition wall spaced above said base wall and coextensive with said side walls, said side walls and said bottom partition wall defining a compartment, said side walls and said base wall defining an inclined cavity beneath said compartment, said side walls having an upright bore and a plurality of first fastening means spaced over the top surface of said side walls, said bottom partition wall having a first aperture connecting said compartment and said cavity and a second aperture connecting the bottom of the inclination of said cavity with the outside of one of said side walls, a support rod removably mounted in said bore, said rod including a plurality of removably connected rod sections, a mounting ring, a shower head, a mounting means connected to said mounting ring and removably connected to the top of said support rod and said shower head, said mounting means being for positioning said ring and said shower head over said compartment, a flexible, waterproof curtain removably mounted to said ring and extending downward into said compartment, said curtain having a plurality of second fastening means formed about the mid section of the curtain commensurate with the four side walls, whereby said curtain mid section is capable of being removably connected to said first fastening means so as to form the cover of the compartment with the rest of the curtain being retaned within the compartment beneath said mid section, a source inlet for pressurized water, a hose means for connecting said source inlet with said shower head, and said shower system having a dismounted position wherein said shower head, said mounting means with said mounting ring, said rod sections and said curtain are dismounted and positioned in said compartment, said shower curtain mid section being connected to said base member via said first and second fastening means.

2. A portable shower system as recited in claim 1, further including a means for carrying waste water from said second aperture to a selected site.

3. A portable shower system as recited in claim 2, further including a pump means positioned in said inclined cavity adjacent to said second aperture for pumping waste water from said cavity through said second aperture.

* * * * *